United States Patent [19]

Bertil

[11] Patent Number: 4,529,517

[45] Date of Patent: Jul. 16, 1985

[54] ARRANGEMENT FOR CLEANING A LIQUID CONTAINING PARTICLES

[76] Inventor: Carlvret Bertil, Magnetgatan 16, 735 00 Surahammar, Sweden

[21] Appl. No.: 552,124

[22] PCT Filed: Mar. 11, 1983

[86] PCT No.: PCT/SE83/00085

§ 371 Date: Oct. 25, 1983

§ 102(e) Date: Oct. 25, 1983

[87] PCT Pub. No.: WO83/03207

PCT Pub. Date: Sep. 29, 1983

[30] Foreign Application Priority Data

Mar. 12, 1982 [SE] Sweden ..... 8201575

[51] Int. Cl.[3] ..... B03C 1/02

[52] U.S. Cl. ..... 210/223

[58] Field of Search ..... 210/222, 223

[56] References Cited

U.S. PATENT DOCUMENTS

| | | | |
|---|---|---|---|
| 1,673,837 | 6/1928 | Lotz | 210/222 |
| 2,798,611 | 7/1957 | Prevost | 210/222 |
| 2,800,230 | 7/1957 | Thoma | 210/223 |
| 4,422,935 | 12/1983 | Mattingly | 210/223 |

*Primary Examiner*—John Adee

*Attorney, Agent, or Firm*—Burns, Doane, Swecker & Mathis

[57] ABSTRACT

Arrangement for cleaning a liquid containing particles, particularly for removing particles or objects such as magnetite, iron shavings, rust etc. which can be attracted by magnetic fields and are contained in the liquid. The liquid is guided so as to traverse a magnetic field produced by a magnet (30) where the magnet (30) is placed separate from the liquid. At least one body (20) which distributes the magnetic field in the liquid is provided in or near the flow path (13) of the liquid. This body is designed as a removable plug (20) combined with an aperture (18) which is formed in the liquid container and a further body (32) which distributes the magnetic field is orientated on the outside of the liquid container (10).

12 Claims, 1 Drawing Figure

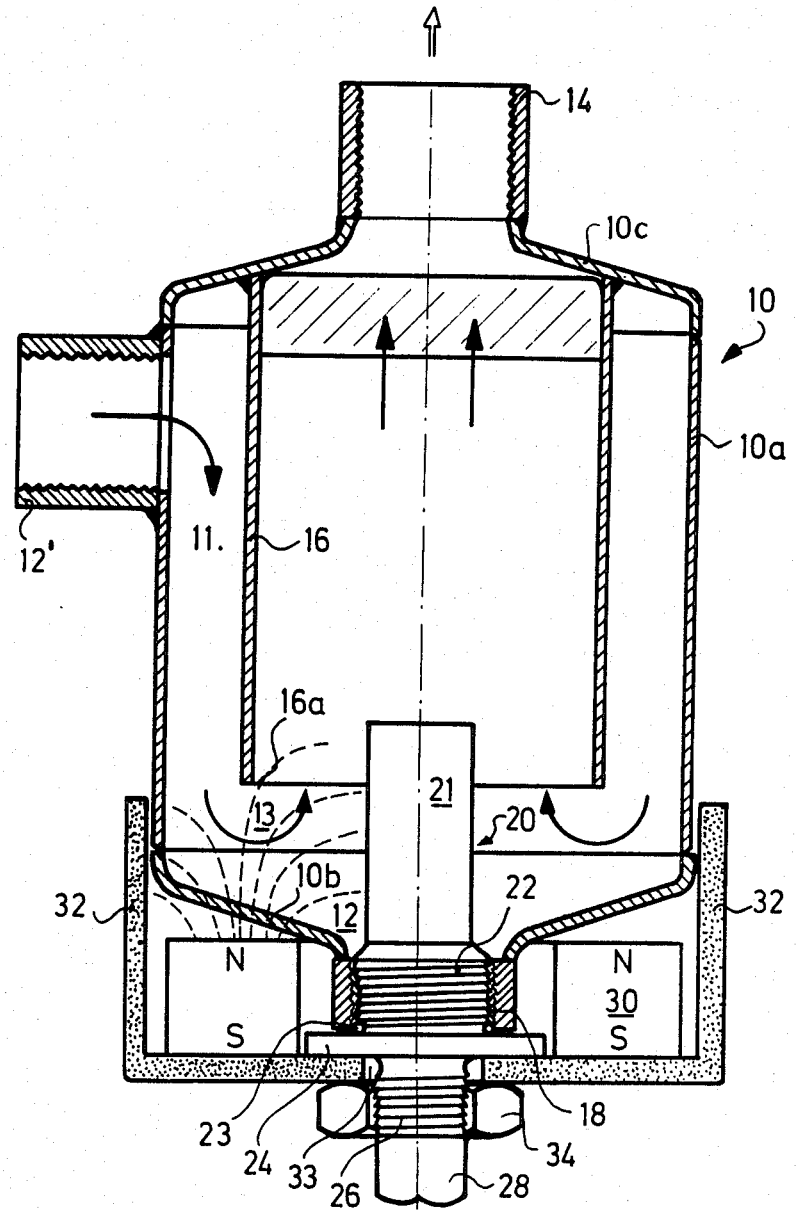
14
10c
10
10a
12'
11.
16
16a
21
13
20
10b
22
12
32
32
N
S
N
30
S
23
24
33
26
28
34
18

ARRANGEMENT FOR CLEANING A LIQUID CONTAINING PARTICLES

TECHNICAL FIELD

The present invention relates to an arrangement for separating out particles which are present in a liquid containing particles and particularly to an arrangement for the separation and removal of particles or objects, capable of attraction by magnetic fields, which are contained in the liquid. Examples of such particles and objects are magnetite, iron shavings, rust and the like.

The invention relates particularly to such arrangements where the liquid is guided so as to traverse a magnetic field produced by a magnet, the magnet being isolated from the liquid. However at least one body which distributes the magnetic field in the liquid is provided in or near the flow path of the liquid.

BACKGROUND

Several arrangements of the type described above are already known.

For the removal of objects made of magnetisable material such as metal shavings, rust flakes and the like from liquids, e.g. heat exchangers in steam boilers and in lubrication systems, the method is already known of using bodies contained in the liquid in the form of plugs made of permanent magnetic material. Here the plugs are so arranged that they project slightly into the flow path of the liquid, or are in a sump, and here create a magnetic field which attracts the magnetisable foreign bodies. Otherwise these would be entrained by the liquid in the liquid flow. Also other arrangements for this purpose are already known.

Thus mention can be made of the fact that by virtue of U.S. Pat. No. 2,798,611 the method is already known of providing two permanent magnets to the underside of an attraction surface and to locate both these magnets in a container.

In German patent specification as filed No. 1 012 871 the method is already known of utilising a number of bodies which distribute the magnetic field in the liquid and which interact with an electromagnet so that the liquid flows through and past a number of magnetisable discs. Here the electromagnetic unit forms one section whilst the container for cleaning the liquid forms the second section, the sections interacting with each other.

The method is already known from British patent specification No. 1 311 794 of cleaning liquid by allowing the liquid to traverse a narrow gap in connection with a strong magnetic field.

Finally it could be mentioned that arrangements of the relevant type are illustrated and described in Danish patent specification No. 82 001, U.S. Pat. No. 1,673,837 and Swedish patent specification No. 111 582.

DESCRIPTION OF THE INVENTION

Technical Problem

However technical problems are involved with the majority of the arrangements known hitherto. Particularly in the case of the plugs made of permanent magnetic material employed earlier, the strength of the magnetic fields is dependent on the size of the magnet and of the air gap. This signifies that relatively constricted flow paths for the liquid must be provided close to the magnet, so as to assure that all the attractable particles are separated out and adhere to the magnet.

With certain applications this involves a disadvantage. Obviously the passage of the liquid through the constricted flow path is rendered difficult by the fact that the particles or objects attracted by the magnetic field become stuck in the flow path and as a result give rise to a further constriction of the flow path.

It has also proved to be a disadvantage that permanent magnetic plugs are difficult to remove when particles and objects attracted by the magnetic field have collected on these. Furthermore it can be a problem to remove accumulated particles on the one hand from the plug and secondly from the immediate vicinity in the liquid container.

Hence it is a difficult technical problem within this technical field to create an arrangement for cleaning a liquid containing particles so as to remove particles in accordance with the conditions specified above where on the one hand the arrangement is simple and practical in design and secondly to ensure that the magnetic field which is to attract the particles does really extend transverse to the fluid flow.

Furthermore it is a difficult technical problem to create conditions such that accumulated particles do not constrict the flow path of the liquid, or in any case cause only a slight constriction.

In addition it is a difficult technical problem to create conditions such that the removal of the removable plug in the liquid container also permits the easy removal of accumulated particles and objects, because at the same time that the plug is removed the magnetic field in the container is also removed, so that the remaining accumulated particles are not subjected to magnetic effects from a magnetic field when they are to be extracted from the container.

The Solution

The present invention proposes an arrangement for cleaning a liquid containing particles, especially for separating out particles or objects such as magnetite, iron shavings, rust etc. which can be attracted by magnetic fields and are contained in the liquid, where the liquid is guided so as to traverse a magnetic field produced by a magnet, where the magnet is located so as to be separate from the liquid, where at least one body which distributes the magnetic field in the liquid is provided in or near the flow path of the liquid.

The particular characteristic of the present invention is that this body is designed as a removable plug combined with an aperture formed in the liquid container, and that a further body which distributes the magnetic field is orientated on the outside of the liquid container.

The present invention furthermore proposes that the body or plug shall be arranged so as to extend some distance into the liquid container and preferably beyond a deflection edge for the liquid flow, where the deflection of the liquid flow shall be 180° or thereabouts.

Furthermore it is proposed that the plug should be arranged to hold the further body which distributes the magnetic field and the magnet in their respective positions when the plug is attached to the aperture of the liquid container.

The body which distributes the magnetic field in the liquid container is designed to extend further from the magnet than the other body which distributes the magnetic field on the outside of the liquid container.

Thus by means of the present invention measures have been taken to ensure that cleaning can take place in a simple and reliable manner without the flow of the liquid being affected to a noteworthy extent and furthermore it will be possible, after a certain service period or as required, to remove the particles or objects which have been separated out, from a collection point which does not impede the passage of the liquid but instead is located at the side of the actual liquid flow or flow path.

Advantages

The particular advantages which can be regarded as characteristic of an arrangement in accordance with the present invention are that special measures have been taken so as to be able to distribute the magnetic field in such a way through the flow path that the entire flow of liquid has to traverse the magnetic field, whilst at the same time measures have been taken to permit the easy removal of accumulated particles under circumstances when the magnetic field is not present.

The characteristic portion of patent claim 1 which follows outlines the characteristic features of an arrangement for cleaning a liquid containing particles in accordance with the present invention.

BRIEF DESCRIPTION OF DRAWINGS

A proposed embodiment exhibiting the significant characteristics of the present invention will be described in greater detail by reference to the appended drawing which illustrates the arrangement in the form of a cylindrical countainer in longitudinal section so as to more clearly illustrate the significant features of the invention.

DESCRIPTION OF THE PROPOSED EMBODIMENT

The container 10 shown in the diagram is made from a non-magnetic material such as stainless steel, plastic or the like and is provided with an inlet 12 for a liquid containing particles which is to be cleaned so as to remove particles attractable by a magnetc field, and has an outlet 14 for the liquid which has thus been cleaned after it has traversed the container 10. The container has a cylindrical intermediate portion 10*a*, a lower portion 10*b* and an upper portion 10*c*. The lower portion 10*b* and the upper portion 10*c* are identical. Portion 10*c* supports a centrally located outlet 14 and portion 10*b* supports a centrally located aperture or drain aperture 18. By means of a cylindrical intermediate wall 16 which is attached inside the upper portion 10*c* of the container 10 and which extends downwards from this upper portion 10*c*, the liquid which flows inwards through the inlet 12 is made to move downwards in the container 10 towards its bottom 10*b*. The annular space 11 formed between the container wall 10*a* and the cylindrical intermediate wall 16 should preferably have a much larger area than that of the inlet pipe or inlet 12, so as to reduce the velocity of the flowing medium, such as the liquid, by which means a settlement chamber 12 is formed underneath the annular space 11 for the particles which have separated out. Because the liquid passes downwards in the annular space 11 from the inlet 12 towards the settlement chamber 12 underneath the edge portion 16*a* of intermediate wall 16, heavy objects or particles can quite easily drop down to the bottom of the container and the settlement chamber 12, regardless of whether these particles can be magnetically influenced or not. The settlement chamber 12 is located at the side of the active liquid path 13.

The bottom portion 10*b* of the container 10 should preferably be tapered so that its walls terminate at the bottom against a centrally arrranged aperture which functions as a drain point and which comprises an internally threaded pipe stub 18. The space adjacent to the pipe stub 18 and to a body 20 functions as the collection point or settlement chamber 12 for separated particles located outside the actual liquid flow 13.

A body or plug 20 which is threaded into the pipe stub 18, has a cylindrical portion 21 which projects centrally into the container and which at its bottom is provided with threads 22 for threading into and interacting with the threads on the pipe stub 18. The plug 20 also has a flange 24 which restricts the depth to which it can be threaded into the pipe stub 18 in the bottom 10*b* of the container. Between the flange 24 and the portion provided with a thread 22 there is a packing ring 23. A section extending below the flange 24 comprises a thread 26 and a square head 28 for an insertion of the plug 20 in pipe stub 18 in the bottom 10*b* of the container.

The plug 20 can consist of a material which can be magnetised by means of a permanent magnet or a coil. Hence the plug 20 is preferably made from a soft iron material, such as a carbon steel with low carbon content, preferably below 0.05% C. For magnetisation of the plug 20 which projects into or near the liquid flow 13 in the interior of container 10 a permanent magnet 30 is provided in the embodiment illustrated which is ring-shaped and is located directly underneath the bottom portion 10*b* of container 10 on the outside of the latter. The magnet 30 is held in position by a casing 32 having a central aperture 33 which passes over the lower threaded portion 26 of plug 20, the casing 32 being thus clamped in position between the flange 24 of the plug and a nut 34 located below this. When the casing 32 with magnet 30 is located in position under the bottom 10*b* of the container 10, as illustrated in the diagram, two closed magnetic fields (of which only one is shown in the diagram) are produced between the magnet 30 and the plug 20 in the container, also between the magnet 30 and the jacket or casing 32, and the magnetised plug 20 can attract the foreign bodies such as magnetite, iron particles etc. which accompany the liquid during its passage past the lower edge 16*a* of the intermediate wall 16 and the cylindrical portion 21 of plug 20. Naturally plug 20 should be capable of consisting of permanent magnet material. Normally the particles should accumulate directly in the settlement chamber 12 because of the direct action of magnet 30.

When particles which have been separated out and have accumulated in the settlement chamber 12 are to be removed from the container 10, nut 34 is unscrewed so that the casing 32 and magnet 30 can be removed from container 10. The plug 20 then becomes non-magnetic and the particles which previously adhered to the plug drop down to the bottom 10*b* of container 10 and together with heavier particles can accumulate in the settlement chamber 12. When plug 20 is removed the accumulated particles in chamber 12 can now drop out. Flushing of the container interior with liquid will also result in removal of the particules in that they accompany the flow of liquid through the drain aperture 18.

If the plug 20 should consist of magnetic material, particles which can be attracted by magnetic fields will adhere to the body 21 and accompany it when the plug is removed. Here too flushing can be appropriate.

Obviously the magnetisation of plug 20 can be achieved by means other than the permanent magnet 30 illustrated, which means can consist of an anisotropic magnet, e.g. with the aid of an electric coil which magnetises the plug 20.

Naturally the intermediate wall 16 which guides the flow of liquid through the concentrated magnetic field at plug 21 can also be replaced by other inserts in the container 10 so as to provide the desired flow paths for the liquid and several plugs can be provided at suitable positions for a larger container, and similarly the magnetisable plug 20 can also have a configuration differing from that illustrated.

The inlet 12 and outlet 14 or the connections thereto on container 10 should preferably be provided with valves to shut off the flow of liquid when emptying the container in order to remove the separated particles and arrangements can also be provided for simplifying this emptying by means of flushing, possibly using the same liquid as traverses the container. As mentioned the container 10 is made from a non-magnetic material such as stainless steel, aluminum or plastic, and in the letter case certain sections can be made transparent so that it is possible to check the quantity of deposited particles from the outside.

It will be evident from what has been stated above that the invention provides an arrangement for cleaning liquids so as to remove magnetisable material or objects, such as magnetite etc., which is extremely effective and permits easy discharge of the separated objects. As indicated by the embodiment described it is suitable for use for example in central heating installations so as to remove magnetite and the like from the circulating water and furthermore can be used with considerable advantage also for closed systems under pressure.

The present invention proposes particularly that a body 21 which distributes the magnetic field in the liquid should be designed as a removable plug 20 connected with a drainage aperature 18 provided in the liquid container, and furthermore a further body 32 which distributes the magnetic field should be provided on the outside of the liquid container 10. The body 20 is arranged to extend some distance into the liquid container and preferably past a deflection edge 16*a* for the flow of liquid 13, where this deflection is illustrated as a deflection through 180°. Naturally deflections through other closely related angular zones are also possible within the framework of the present invention.

As mentioned previously the plug 20 is designed to hold the furthher body 32 which distributes the magnetic field and also the magnet 30 in their respective positions when the plug is attached to the liquid container 10. The body 20 which distributes the magnetic field is designed to extend further from the magnet 30 than the other body 32 which distributes the magnetic field with the line connecting the uppermost portions of these bodies passing through the deflection edge 16*a* for the flow of medium.

In all cases the body 20 and portion 32 consist of a material which conducts a magnetic field. Portion 32 supports the permanent magnet 30 which is given a polarity as indicated by the diagram. By this means the field of force indicated on the left hand side of the diagram is produced.

The embodiment whereby the polarity of the magnet is orientated horizontally, so that the magnetic field extends straight between portions 32 and 21 past the edge 16, also lies within the framework of the present invention.

It should be possible for portion 16 to consist of a material which distributes magnetic fields. (Magnetically-conductive or permanent magnetic material).

When liquid passes into the container 10 via the inlet 12 it is proposed that measures be adopted so that the flow of liquid rotates in the space 11 around wall section 16. The increase in area can be so selected that the liquid velocity is 10 times lower in chamber 11 than it is in the inlet 12.

Obviously the invention is not restricted to the embodiments illustrated but can be varied and modified within the framework of the patent claims which follow.

I claim:

1. An arrangement for cleaning a liquid containing magnetically attractable particles, comprising:

a non-magnetic container, said liquid being guided inside the container so as to traverse a magnetic field produced by a magnet arranged outside said container;

at least one body which distributes the magnetic field in the liquid, said at least one body comprising a removable plug received within an aperture provided in the container, said at least one body extending into the container beyond a region within the container wherein the direction of flow of the liquid substantially reverses, said at least one body being magnetizable by said magnet arranged at a predetermined distance from said at least one body with said container separating the liquid from said magnet; and a further body provided on the outside of the container to distribute the magnetic field.

2. The arrangement of claim 1 wherein said removable plug is adapted to hold said further body and the magnet in their respective positions when the removable plug is attached to the container.

3. The arrangement of claim 1 wherein said at least one body extends farther from the magnet than said further body.

4. The arrangement of claim 1 wherein said container has an upper portion, a bottom portion and an intermediate portion and an inlet and an outlet for the liquid which is to be cleaned, and an intermediate wall which extends within the intermediate portion of said container from the upper portion of the container, and together with the lowest portion of the container, forms a chamber for the settlement of heavier particles, said intermediate wall forcing the liquid to flow downwards to the bottom portion of the container, said removable plug being inserted in the center of the bottom portion, said magnet being provided underneath the bottom portion of the container and separate from the interior of the container, said further body being made of magnetizable material and holding the magnet in position.

5. The arrangement of claim 1, wherein said at least one body is made of carbon steel with carbon content less than 0.05% C. and wherein said further body is made from magnetizable material.

6. The arrangement of claim 1 wherein said further body comprises a casing provided underneath the bottom portion of the container and attached to the container by a projecting threaded portion of said at least one body, said casing supporting the magnet or the like for magnetisation of the body.

7. The arrangement of claim 4 wherein said at least one body is made of carbon steel with carbon content less than 0.05% C.

8. The arrangement of claim 2 wherein said further body comprises a casing provided underneath the bottom portion of the container and attached to the container by a projecting threaded portion of said at least one body, said casing supporting the magnet or the like for magnetisation of the body.

9. The arrangement of claim 3 wherein said further body comprises a casing provided underneath the bottom portion of the container and attached to the container by a projecting threaded portion of said at least one body, said casing supporting the magnet or the like for magnetisation of the body.

10. The arrangement of claim 4 wherein said further body comprises a casing provided underneath the bottom portion of the container and attached to the container by a projection threaded portion of said at least one body, said casing supporting the magnet or the like for magnetisation of the body.

11. The arrangement of claim 5 wherein said further body comprises a casing provided underneath the bottom portion of the container and attached to the container by a projecting threaded portion of said at least one body, said casing supporting the magnet.

12. The arrangement of claim 4 wherein a lowermost portion of said intermediate wall defines a deflection edge with said removable plug extending upwardly in said container beyond said deflection edge of said intermediate wall.

* * * * *

UNITED STATES PATENT AND TRADEMARK OFFICE

CERTIFICATE OF CORRECTION

PATENT NO. : 4,529,517

DATED : July 16, 1985

INVENTOR(S) : BERTIL CARLVRET

It is certified that error appears in the above-identified patent and that said Letters Patent is hereby corrected as shown below:

On the title page;

Change name of inventor to read:

BERTIL CARLVRET

Signed and Sealed this

*Eighth* Day of *October 1985*

[SEAL]

*Attest:*

DONALD J. QUIGG

*Attesting Officer*

*Commissioner of Patents and Trademarks—Designate*